US006270654B1

(12) United States Patent
Colyar et al.

(10) Patent No.: US 6,270,654 B1
(45) **Date of Patent: *Aug. 7, 2001**

(54) CATALYTIC HYDROGENATION PROCESS UTILIZING MULTI-STAGE EBULLATED BED REACTORS

(75) Inventors: James J. Colyar, Newtown, PA (US); James B. MacArthur, Denville; Eric D. Peer, Hillsborough, both of NJ (US)

(73) Assignee: IFP North America, Inc., Princeton, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/087,181

(22) Filed: May 29, 1998

Related U.S. Application Data

(63) Continuation-in-part of application No. 08/406,016, filed on Mar. 16, 1995, now abandoned, which is a continuation-in-part of application No. 08/107,870, filed on Aug. 18, 1993, now abandoned.

(51) Int. Cl.[7] ..... C10G 45/00

(52) U.S. Cl. ..... 208/57; 208/58; 208/59; 208/108; 208/143; 208/153; 208/157

(58) Field of Search ..... 208/58, 57, 59, 208/108, 143, 153, 157

(56) References Cited

U.S. PATENT DOCUMENTS

| | | | | |
|---|---|---|---|---|
| 3,207,688 | * | 9/1965 | Van Driesen | 208/59 |
| 3,215,617 | * | 11/1965 | Burch et al. | 208/59 |
| 3,254,017 | * | 5/1966 | Arey, Jr. et al. | 208/59 |
| 3,287,252 | * | 11/1966 | Young | 208/59 |
| 4,576,710 | * | 3/1986 | Nongbri et al. | 208/58 |
| 4,591,426 | * | 5/1986 | Krasuk et al. | 208/96 |
| 4,746,419 | * | 5/1988 | Peck et al. | 208/213 |
| 4,902,407 | * | 2/1990 | Chan et al. | 208/152 |
| 4,950,384 | * | 8/1990 | Groeneveld et al. | 208/59 |

* cited by examiner

*Primary Examiner*—Nadine Preisch
(74) *Attorney, Agent, or Firm*—John F. Ritter

(57) ABSTRACT

A process for catalytic multi-stage hydrogenation of heavy carbonaceous feedstocks using catalytic ebullated bed reactors is operated at selected flow and operating conditions so as to provide improved reactor operations and produce increased yield of lower boiling hydrocarbon liquid and gas products. The disclosed process advantageously takes advantage of an external gas/liquid separation unit associated with the first stage reactor to allow for a more efficient and effective catalytic hydrocracking process. The more efficient process is primarily a result of the increased catalyst loading and lower gas hold-up in the ebullated reactors.

16 Claims, 3 Drawing Sheets

CATALYTIC HYDROGENATION PROCESS UTILIZING MULTI-STAGE EBULLATED BED REACTORS

This is a continuation-in-part application of Ser. No. 08/406,016, filed Mar. 16, 1995, now abandoned, which was a continuation-in-part of Ser. No. 08/107,870, filed Aug. 18, 1993, and now abandoned.

BACKGROUND OF INVENTION

This invention pertains to improved catalytic hydrogenation of heavy hydrocarbonaceous feedstocks utilizing catalytic multi-stage ebullated bed reactors for producing desired lower boiling hydrocarbon liquid products. It pertains particularly to such catalytic multi-stage hydrogenation processes having increased catalyst loading and liquid volume together with reduced gas hold-up in each reactor, and thereby provides improved performance efficiency for the processes.

In conventional catalytic hydrogenation processes for heavy hydrocarbon feedstocks utilizing multi-stage ebullated bed reactors, the hydrogen gas recycle rate in each reactor is usually kept relatively high to assure that excess hydrogen gas exists in the catalyst bed to provide the necessary chemical hydrogenation reactions with the feedstock. However, such excess hydrogen flow requires relatively high superficial gas velocities in the reactor(s), which results in less available volume for the reacting liquid and increased gas hold-up in the reactor. Because the feedstock hydrogenation and hydrocracking reactions occur predominantly in the liquid phase, this conventional practice has the result of undesirably reducing the percentage of feedstock liquid being exposed to and reacted with the catalyst in the reactor, and undesirably reduces process performance. Also, for known catalytic ebullated bed type reactors which utilize internal gas/liquid separation devices, the volume of catalyst in a particular size reactor is undesirably limited.

Many prior art patents have been directed to various improvements in catalytic hydrogenation processes for heavy hydrocarbon feedstocks utilizing catalytic ebullated bed reactors, and have disclosed various operational parameters for such reactors. For example, U.S. Pat. No. 3,183,180 to Schuman et al, U.S. Pat. Nos. 4,217,206 and 4,427,535 to Nongbri et al disclose hydrogenation of petroleum residua using catalytic single stage ebullated bed reactors having internal gas/liquid separation, and U.S. Pat. No. 4,576,710 to Nongbri et al and U.S. Pat. No. 4,853,111 to MacArthur et al disclose use of such catalytic two-stage reactors. Other prior art patents have disclosed hydrogenation process improvements utilizing catalysts having various compositions and pore structures, and specific reaction conditions based on characteristics of the feedstocks. However, a need still remains for providing a comprehensive improved catalytic multi-stage ebullated bed reactor system which is capable of producing improved hydrogenation process performance efficiencies.

SUMMARY OF INVENTION

This invention provides an improved catalytic multi-stage hydrogenation process for treating heavy hydrocarbonaceous feedstocks and producing desired lower boiling hydrocarbon liquid products with enhanced process performance. For this improved hydrogenation process, we have discovered that a more efficient catalytic multi-stage ebullated bed reactor system having improved performance results can be achieved by maximizing the catalyst loading and also providing increased reactor liquid residence time in each reactor, by utilizing reduced catalyst space velocity and reduced superficial gas velocity which are maintained within desired critical ranges in each reactor. These process improvements result in desirably increasing the liquid hold-up volume percent and reducing excessive gas hold-up volume percent in each of the reactors. These desirable reaction results are accomplished by providing such increased volume percent of particulate catalyst and lower catalyst space velocities in each reactor by utilizing an external gas/liquid separator, in combination with utilizing lower superficial upward gas velocities and reduced gas hold-up in each reactor, while providing a desired outlet hydrogen partial pressure and desired level of hydrogenation or hydroconversion as selected for any particular feedstock.

For this invention, the catalytic ebullated bed reactor construction arrangement for the first stage reactor does not include an internal gas/liquid separation device, but instead utilizes an efficient external gas/liquid separator. Utilizing such external gas/liquid separation results in an increased volume of particulate catalyst being provided in a particular size reactor and reduces the catalyst space velocity, which is defined as the volumetric rate of feedstock processed per unit weight of fresh catalyst in the reactor. For such commercial size reactors having outside diameter of 12–14 ft. and a height of 50–60 ft., a vertical distance of 5–10 ft. should be maintained between the ebullated bed maximum expansion level and the reactor outlet conduit, so as to avoid any carryover of catalyst from the reactor. Also, operating conditions for each of the two-staged catalytic ebullated bed reactors are selected so that the upward superficial gas velocity is maintained within a desired critical range, and the gas hold-up volume percentage in each reactor is beneficially reduced, which consequently permits more reactor liquid to be in contact with the catalyst bed, so that the reactor performance as well as the overall process performance results are enhanced. This invention is useful for processing heavy hydrocarbonaceous feedstocks and providing overall hydroconversions in the range of 50–100 vol. % to produce desired lower boiling hydrocarbon liquid products.

The broad and preferred characteristics for the hydrocarbonaceous feedstocks and the reactor broad and preferred operating condition ranges for which this invention is useful are provided in Table 1 below:

TABLE 1

FEEDSTOCK AND REACTOR OPERATING CONDITIONS

| Condition | Broad | Preferred |
|---|---|---|
| Feedstock Residua Content, vol. % 975° F.$^+$ | 30–100 | 50–90 |
| Feedstock CCR*, wt. % | 1–50 | 10–40 |
| Feedstock Nickel plus Vanadium, Wppm | Up to 1,000 | 100–800 |
| Reactor LHSV**, $hr^{-1}$ (per Reactor Stage) | 0.2–2.0 | 0.4–1.2 |
| Reactor Temperature, ° F. | 700–850 | 750–840 |
| Reactor Total Pressure, Psig | 1,000–4,000 | 1,500–3,000 |
| Reactor Outlet Hydrogen Partial Pressure, Psi | 800–3,000 | 1,000–2,500 |
| Reactor Superficial Gas Velocity, fps | 0.02–0.30 | 0.025–0.20 |
| Catalyst Space Velocity, BPD/Lb (per Stage) | 0.03–0.33 | 0.04–0.20 |
| Catalyst Replacement Rate, Lb/Bbl (per Stage) | 0.05–0.5 | 0.1–0.4 |

TABLE 1-continued

FEEDSTOCK AND REACTOR OPERATING CONDITIONS

| Condition | Broad | Preferred |
|---|---|---|
| Catalyst Bed Expansion, % | 25–75 | 35–50 |
| Vacuum Bottoms Recycle Rate, $V_r/V_{feed}$ | 0–1 | 0.2–0.7 |
| Cutpoint of Vacuum Bottoms Recycle, ° F. | 650+ | 900+ |

*CCR = Conradson carbon residue.
**LHSV = Liquid hourly space velocity in each reactor, as defined as volumetric fresh feed rate divided by reactor total volume.

In the process, the fresh feedstock together with hydrogen are introduced into a first stage catalytic ebullated bed reactor, which does not contain an internal gas/liquid phase separator device. The catalyst bed is expanded by 25–75 percent above its settled level by the upflowing liquid and gas streams, and is maintained within the broad operating conditions of 700–850° F. temperature, 800–3,000 psig hydrogen partial pressure at the reactor outlet, liquid hourly space velocity of 0.20–2.0 volume fresh feed per hour per volume of reactor ($V_f$/hr/$V_r$) and at catalyst space velocity of 0.03–0.33 barrel feed per day per pound fresh catalyst in the reactor. Because of the lower catalyst space velocity and superficial gas velocity being utilized in the reactor, the reacting liquid volume percentage is increased and gas hold-up volume is desirably reduced. The first stage reactor usually hydroconverts 30–95 vol. % of the fresh heavy feedstock and any recycled residua material to a lower boiling hydrocarbon effluent material.

The first stage reactor effluent material is phase separated in an external gas/liquid separator, a gas fraction is removed, and a sufficient portion of the remaining liquid is recycled to the reactor to maintain the desired 25–75% catalyst bed expansion therein. The remaining liquid fraction is passed together with additional hydrogen to a second stage catalytic ebullated bed type reactor. The second stage ebullated bed reactor is operated similarly to the first stage reactor and typically is maintained at 0–50° F., lower temperature in the broad range of 700–850° F. (370–455° C.) and 0.20–2.0 $V_f$/hr/$V_r$ space velocity, so as to effectively further hydrogenate the remaining unconverted residua material therein. The second stage reactor usually further hydroconverts 30–95 vol. % of the remaining residua feed material to lower boiling hydrocarbon materials.

From the second stage reactor, the effluent material is passed to various gas/liquid separation and distillation steps, from which gases and low-boiling hydrocarbon liquid product and distillation vacuum bottoms fraction materials are removed. If desired for achieving higher percentage conversion of the feedstock, a portion of the vacuum bottoms fraction material boiling above at least 650° F. (343° C.) temperature and preferably boiling above about 900° F. (482° C.) can be recycled back to the first stage catalytic reactor inlet at a recycle volume ratio to the fresh feedstock of 0–1.0/1, and preferably at 0.2–0.7/1 recycle ratio for further hydroconversion reactions therein.

Particulate catalyst materials which are useful in this hydrogenation process may contain 2–25 wt. percent total active metals selected from the metals group consisting of cadmium, chromium, cobalt, iron, molybdenum, nickel, tin, tungsten, and mixtures thereof deposited on a support material selected from the group consisting of alumina, silica and combinations thereof. Also, catalysts having the same characteristics may be used in both the first stage and second stage reactors, or each reactor may use catalysts having different characteristics. Useful particulate catalysts will be in the form of beads, extrudates or spheres and have broad and preferred characteristics as shown in Table 2 below:

TABLE 2

USEFUL CATALYST CHARACTERISTICS

| Catalyst Characteristic | Broad | Preferred |
|---|---|---|
| Particle Diameter, in. | 0.025–0.083 | 0.030–0.065 |
| Particle Diameter, mm | 0.63–2.1 | 0.75–1.65 |
| Bulk Density, lb/ft$^3$ | 25–50 | 30–45 |
| Particle Crush Strength, lb/mm | 1.8 min. | 2.0 min. |
| Total Active Metals Content, wt. % | 2–25 | 5–20 |
| Total Pore Volume, cm$^2$/gm* | 0.30–1.50 | 0.40–1.20 |
| Total Surface Area, m$^2$/gm | 100–400 | 150–350 |
| Average Pore Diameter, Angstrom** | 50–350 | 80–250 |

*Determined by mercury penetration method at 60,000 psi pressure.
**Average pore diameter calculated by ADP = 4 Pore Volume/Surface Area × $10^4$ Catalysts having unimodal, bimodal and trimodal pore size distributions are useful in this process. Preferred catalysts should contain 5–20 wt. % total active metals consisting of combinations of cobalt, molybdenum and nickel deposited on an alumina support material.

This improved process for catalytic multi-stage hydrogenation of heavy hydrocarbonaceous feedstocks advantageously provides enhanced performance results by utilizing increased catalyst loading and liquid volume percent together with reduced gas hold-up in each of the multiple staged reactors with external gas/liquid separation. Such enhanced performance efficiency is manifested principally by providing better utilization of the reactor volume for any particular desired hydroconversion result. This process is generally useful for catalytic hydrogenation and hydroconversion of heavy petroleum crudes, topped crudes, and vacuum residua, bitumen from tar sands, for coal hydrogenation and liquefaction, and for catalytic co-processing coal/oil blends to produce lower boiling, higher value hydrocarbon liquid products.

BRIEF DESCRIPTION OF DRAWINGS

This invention will be described further with the aid of the following drawings, in which.

DESCRIPTION OF INVENTION

Figure 1:
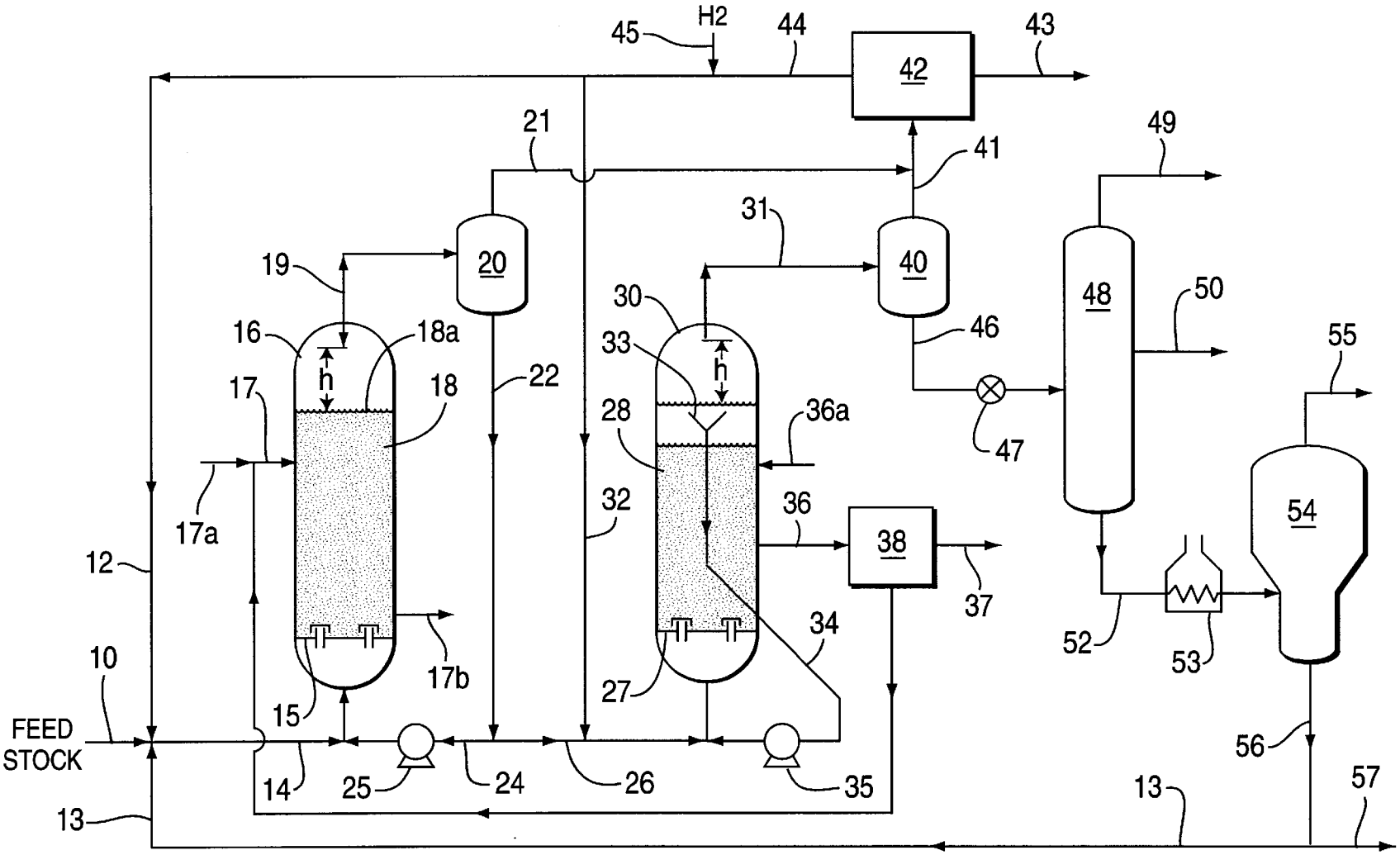
FIG. 1 is a schematic flow diagram of an improved catalytic two-stage hydrogenation process for heavy hydrocarbonaceous feedstocks for producing desired lower-boiling liquid and gas products according to the invention.

The present invention is now described in more detail for a hydrogenation process utilizing an improved catalytic two-stage ebullated bed reaction system for treating heavy hydrocarbon feedstocks. For the process as shown by FIG. 1, a pressurized heavy hydrocarbon feedstock such as petroleum vacuum residua containing 30–100 vol. % 975° F.+ residua and preferably 50–90 vol. % is provided at 10 and combined with hydrogen at 12. A heavy vacuum bottoms recycle liquid can be added at 13, and the combined stream at 14 is pressurized and fed through flow distributor 15 upwardly into first stage catalytic ebullated bed reactor 16 containing ebullated bed 18. The total feedstock to reactor 16 consists of the fresh hydrocarbon feed material at 10 plus any recycled vacuum bottoms material at 13. The recycle volume ratio of the vacuum bottoms material to the fresh oil feedstock is in the range of 0–1.0/1, and preferably is 0.2–0.7/1 recycle ratio, with the higher recycle ratios being used for achieving higher overall percentage conversion of the feedstock residua.

The first stage reactor 16 contains an ebullated bed 18 of particulate supported type catalyst having the form of beads, extrudates, spheres, etc., and is maintained within the range of broad and preferred operating conditions as shown in Table 1 above. The physical level of catalyst at 18*a* in the reactor is higher than for typical ebullated-bed reactors. This is because the usual internal recycle cup device which occupies a significant portion of reactor height, is not provided for separating the reactor liquid and vapor portions within the reactor 16. Instead, an external or interstage phase separator 20 is provided between the first and second stage catalytic reactors to effectively separate the reactor liquid and vapor effluent portions. Removal of the usual internal recycle cup separator results in more catalyst and a higher level for the expanded catalyst bed in the reactor and desirably provides for a lower catalyst space velocity, which contributes to the higher levels of performance for the reactors. A vertical height distance "h" of 5–10 ft. is maintained between the maximum bed expansion level and the inlet of reactor outlet conduit 19 to prevent carryover of catalyst particles from the expanded bed 18.

From first stage reactor 16, overhead effluent stream 19 is withdrawn and passed to the external phase separator 20. From separator 20, a vapor stream 21 is removed and passed to gas purification section 42. Also, a liquid stream 22 is withdrawn, and a sufficient flow is recirculated through conduit 24 by ebullating pump 25 back to the reactor 16 to expand the catalyst bed 18 by the desired 25–75 percent above its normal settled bed height. For the first stage reactor 16, particulate catalyst material is added at connection 17 at the desired replacement rate, and can be used catalyst withdrawn from second stage reactor 30 at connection 36, and usually treated at unit 38 as desired to remove undesired particulate fines, etc. at 37. Fresh make-up catalyst can be added to catalyst bed 18 as needed at connection 17*a*, and an equivalent amount of spent catalyst is withdrawn from catalyst bed 18 at connection 17*b*.

Figure 2:
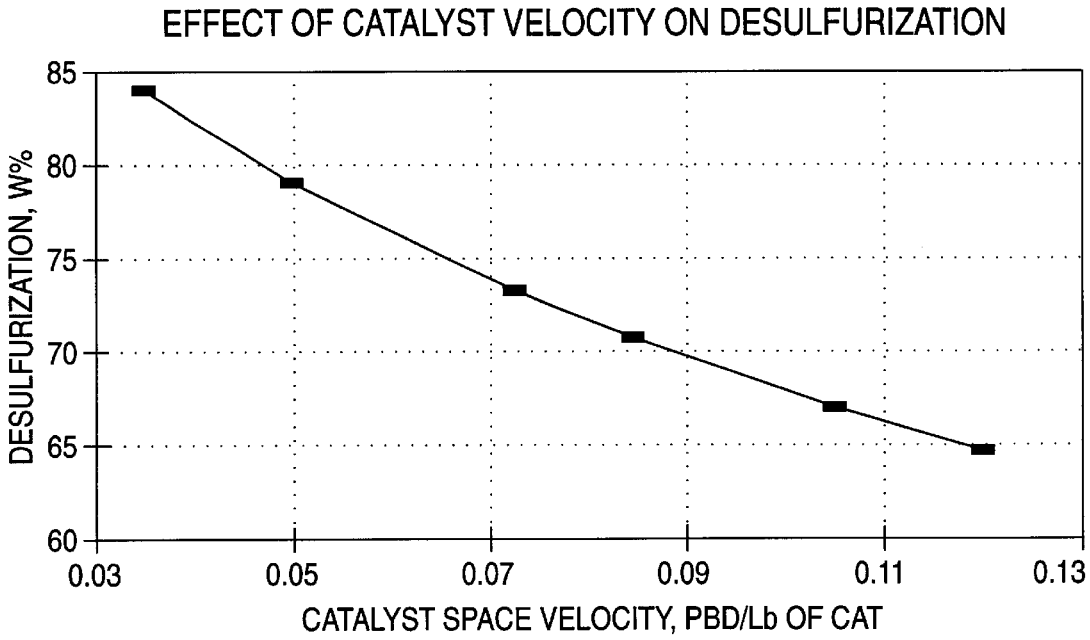
FIG. 2 is a graph generally showing the typical general relationship between catalyst space velocity for a catalytic ebullated bed reactor and feedstock hydrodesulfurization results for the reactor.

The typical general relationship between reactor catalyst space velocity and reactor performance results is illustrated in FIG. 2, which shows the effect of lower catalyst space velocities on hydrodesulfurization performance for ebullated-bed reactors having equal total volumes, hydrocarbon feedrates, reaction temperatures and catalyst replacement rates. FIG. 2 clearly shows the improvement in first stage reactor desulfurization performance provided by lower catalyst space velocities, resulting mainly from use of an external gas/liquid separation device instead of the usual internal separation device and for nominal residue conversion levels between about 65 and 90 vol. % or between 50 and 100 vol. %. The hydrocarbon liquid feedstock and hydrogen both react in contact with the catalyst in the reactor ebullated bed to form lower boiling components which have lower contaminant levels than the feedstock.

The hydrogen gas provided at 12 to the first stage reactor 16 is mainly recycled unreacted hydrogen having purity in the range of 85–95 vol. percent and some essentially pure make-up hydrogen as needed. For this improved process, the hydrogen feed rate to the first stage reactor and to the subsequent staged reactors is established at a minimum required level, which provides at each reactor outlet a required hydrogen partial pressure which is determined based on characteristics for a particular feedstock, the catalyst characteristics, the desired level of reaction severity, and the product quality objectives. Typically, the required hydrogen feed rate to a catalytic reactor is expressed as a multiple of the quantity of hydrogen chemically consumed in the reactor, and such hydrogen rate is usually in the range of 2.0 to 5.0 times the chemical hydrogen consumption therein. Minimizing hydrogen gas feed rate in the catalytic ebullated-bed reactor(s) results in lower gas hold-up of hydrogen and hydrocarbon vapor evolved therein, and provides longer liquid residence time and enhanced liquid phase kinetics at the catalyst surface. The longer reactor liquid residence time is explained by the following relationship:

$$\text{Reactor Liquid Residence Time} = \frac{\text{Volume of Reactor Occupied by Liquid}^{*}}{\text{Liquid Hourly Space Velocity}^{**}}$$

* Reactor volume occupied by Liquid = Volume total – Volume occupied by Gas – Volume occupied by solid (catalyst)

** Volumetricrate of fresh liquid feed divided by reactor total volume

Figure 3:
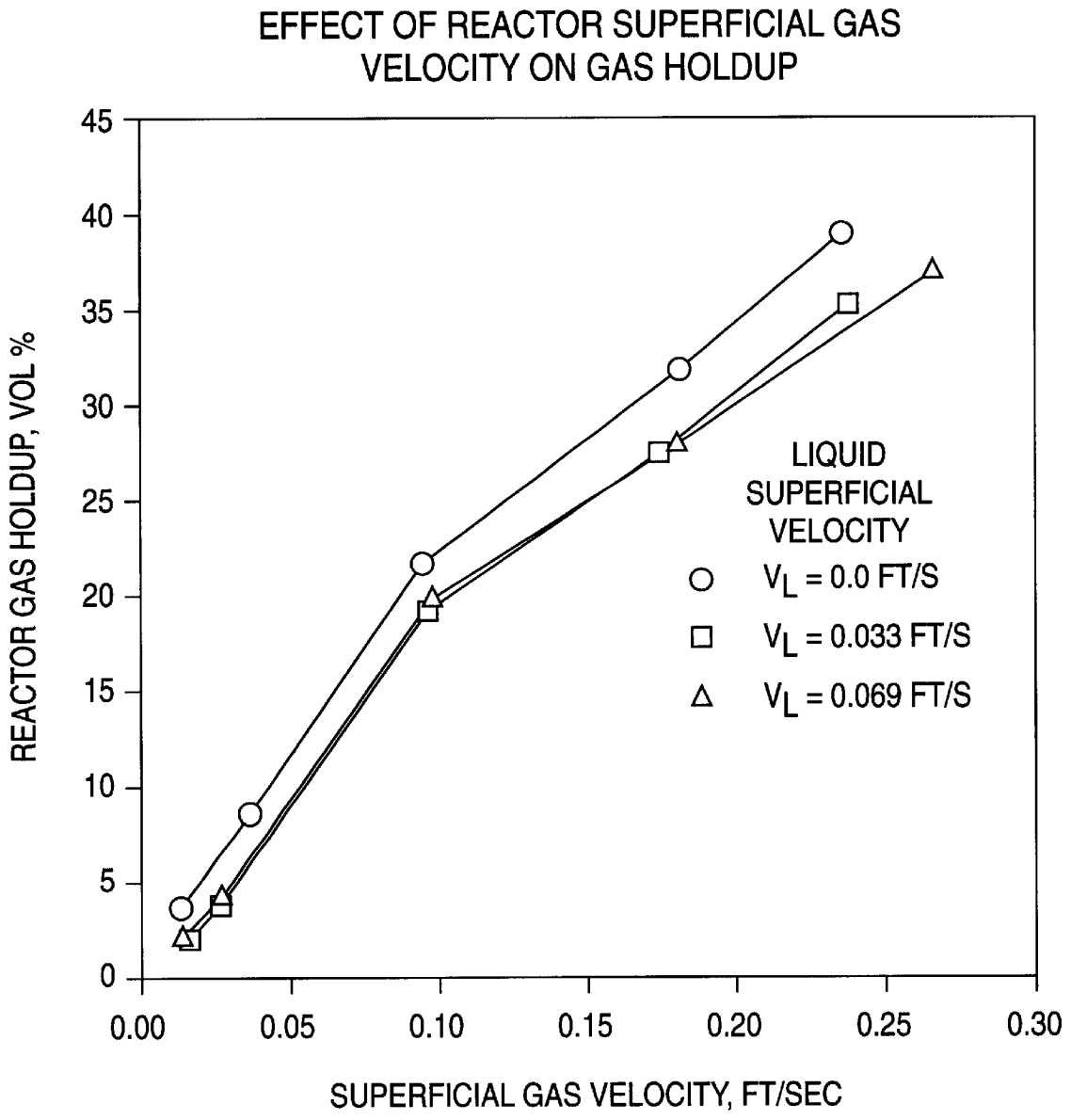
FIG. 3 is a graph of experimental data generally showing the relationship between superficial gas velocity in a catalytic ebullated bed reactor and gas hold-up volume percentage in the reactor for various superficial liquid velocities.

The volume percent of hydrogen gas hold-up in the catalytic ebullated-bed reactor including hydrocarbon vapors generated therein, is primarily related to the reactor superficial gas velocity, with increased upward superficial gas velocity resulting in an increased gas hold-up volume percentage in the reactor. Experimental data showing this relationship between the upward superficial gas velocity and gas hold-up volume percent in catalytic ebullated-bed reactors is shown in FIG. 3. The measured gas hold-up volume percent in the reactor is shown as a function of the reactor superficial gas velocity at three different levels of reactor liquid upward superficial velocity. The superficial gas velocity for upflowing hydrogen gas clearly has the primary effect on gas hold-up volume in the reactor, with a secondary effect being due to different superficial liquid upward velocities for the feed liquid in the reactor.

Regarding the need for providing a sufficient quantity of reactant hydrogen gas in the reactor for desired chemical consumption therein, recent laboratory studies at gas hold-up percentages less than about 5–10 vol. % have clearly shown that this is a sufficient hydrogen quantity. Gas hold-up in excess of about ~5 vol. % has usually been a consequence of scale-up of small size experimental catalytic ebullated-bed reactors to commercial size reactors (i.e., for taller reactors having lower length/diameter ratios than for slender laboratory scale reactors), and result in a less efficient reaction system because the liquid residence times and gas hold-up volumes are usually adversely affected. The present invention advantageously minimizes this excessive hydrogen gas and hydrocarbon vapor hold-up volume percentage in the reactor, so as to provide the enhanced reaction kinetics and higher overall levels of process performance for the reactor system.

Figure 4:
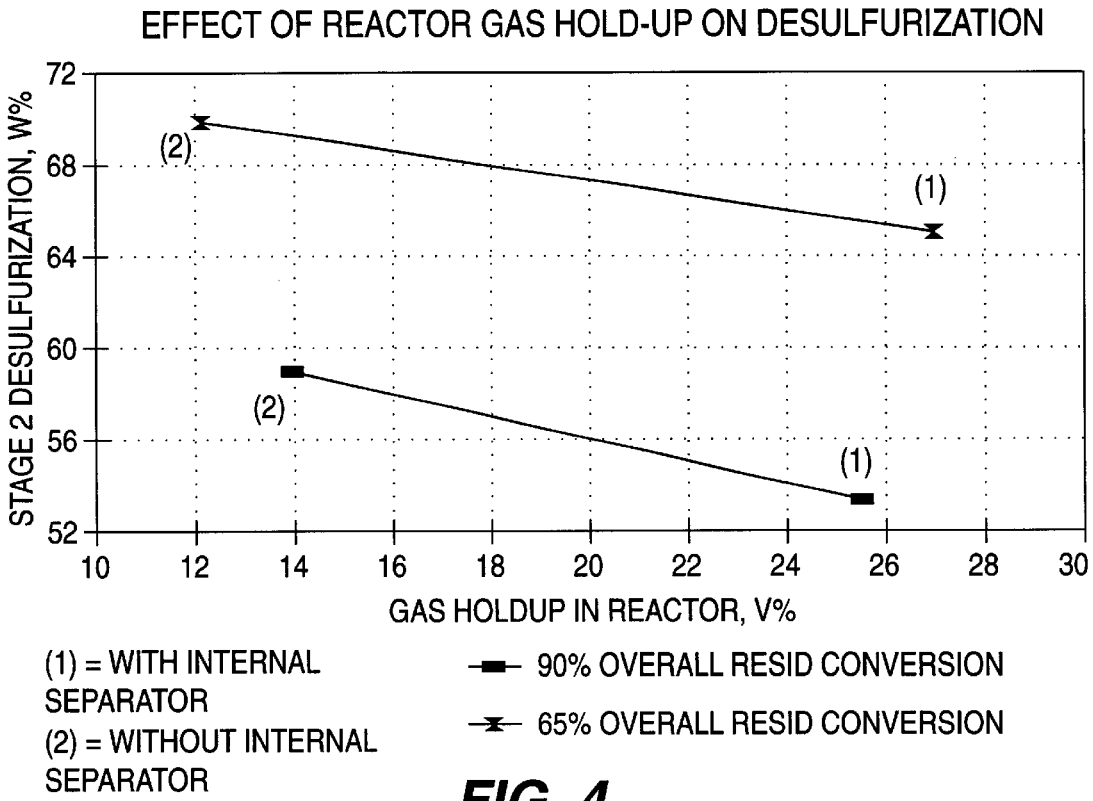
FIG. 4 is a graph generally showing the effect of reactor gas hold-up volume percent on hydrodesulfurization results particularly in a second stage catalytic reactor.

This relationship of catalytic reactor performance such as percent hydroconversion, hydrodesulfurization, etc. of the heavy hydrocarbon feedstock to the percentage of gas hold-up in an ebullated bed reactor is further illustrated in FIG. 4.

This comparison was made for catalytic ebullated bed reactors having equal total volumes, hydrocarbon feedrates, reaction temperatures and catalyst replacement rates. The results indicate that for reduced gas hold-up in a second stage reactor, the hydrodesulfurization results are significantly increased for various overall hydroconversion levels of 65 vol. % and 90 vol. % for the feedstock.

As mentioned above, the first stage reactor effluent stream 19 is passed to the interstage separator 20, which has two main functions: (a) to provide an ebullating recycle liquid stream back to the first stage reactor with minimal gas entrainment, and (b) to provide a liquid feed stream to the second stage reactor 30 having a minimal vapor content. The effect of the function (b) is reduced gas hold-up in the second stage reactor and the same reaction benefits as described for the first stage reactor. The liquid feed to the second stage reactor 30 contains the unconverted residue from the original feedstock, and hydroconversion fractions which normally boil above about 600° F. (316° C.). Recycled hydrogen, together with fresh make-up hydrogen at 45 is added as stream 32 to the second stage reactor 30, the hydrogen gas rate being selected so as to result in a minimal hydrogen partial pressure at the reactor 30 outlet as needed to meet processing and product objectives as described above. Relative to typical hydrogen gas rates previously used, the gas rate provided at 32 to the second stage reactor 30 for this invention is substantially lower. This results in lower gas hold-up volume percentages in the reactor, greater liquid residence time, and a more efficient reactor system. In this situation, the gas hold-up is reduced from about 27 to 12 vol. percent, which results in an improvement in second stage desulfurization results from 65 to 70 wt. % based on the fresh feedstock.

Also from the external phase separator 20, a liquid portion 26 from the liquid stream 22 provides liquid feed material upwardly through flow distributor 27 into ebullated bed 28 of the second stage catalytic ebullated bed reactor 30. The catalyst bed 28 is expanded by 25–75% above its settled height by the upflowing gas and liquid therein. Reactor liquid is withdrawn from an internal phase separator 33 through conduit 34 to recycle pump 35, and is reintroduced upwardly through the flow distributor 27 into the ebullated bed 28 to maintain the desired catalyst bed expansion therein.

The second stage catalytic reactor 30 with ebullated catalyst bed 28 is operated within the broad and preferred conditions as shown in Table 1 above, and maximizes resid hydrogenation reactions which occur therein. The second stage reaction temperature is preferably 0–50° F. lower than that of the first stage reactor. Recycle and fresh hydrogen is provided at 32 to the second stage reactor 30, so that a minimal but adequate level of hydrogen partial pressure of 1,000–2,500 psi is maintained at the reactor 30 outlet. The fresh catalyst replacement rate provided to the second stage reactor is 0.005–0.50 pound per barrel.

The catalyst particles in ebullated beds 18 and 28 have a relatively narrow size range for uniform bed expansion under controlled upward liquid and gas flow conditions. While the useful catalyst size range is between 0.025 and 0.083 inch effective diameter, including beads, extrudates, or spheres, the catalyst size is preferably particles having sizes of 0.030–0.065 inch effective diameter. In the reactor, the density of the catalyst particles, and the lifting effect of the upflowing liquid and hydrogen gas are important factors in providing the desired 25–75 percent expansion and operation of the catalyst beds. If desired, used particulate catalyst may be withdrawn from the second stage reactor bed 28 at connection 36 and fresh catalyst is added at connection **36*a* as needed to maintain the desired catalyst volume and catalytic activity therein. This used catalyst withdrawn at 36, which has relatively low metal contaminant concentration, can be passed to a treatment unit 38 where it is washed and screened to remove undesired fines at 37, and the recovered catalyst at 39 can provide used catalyst addition at 17 to the first stage reactor bed 18, together with any fresh make-up catalyst added at connection 17*a*** as needed.

From the second stage reactor 30, an effluent stream is removed at 31 and passed to a phase separator 40. From separator 40, a hydrogen-containing gas stream 41 is passed to the gas purification section 42 for removal of contaminants such as $CO_2$, $H_2S$, and $NH_3$ at vent 43. Purified hydrogen at 44 is recycled back to each catalytic reactor 16 and 30 as desired as the hydrogen streams 12 and 32 respectively, while fresh hydrogen is added at 45 as needed.

Also from the separator 40, a liquid fraction 46 is withdrawn, pressure-reduced at 47 to 0–100 psig, and is introduced into fractionation tower unit 48. A gaseous product stream is removed at 49 and a light hydrocarbon liquid product normally boiling between 400–650° F. is withdrawn at 50. A bottoms nominal 650° F.$^+$ fraction is withdrawn at 52, reheated at heater 53, and passed to vacuum distillation step at 54. A vacuum gas oil liquid product is removed overhead at 55. Vacuum bottoms stream 56, which has been hydrogenated in the second stage catalyst reactor 30, can be recycled back as stream 13 to the first stage catalytic reactor 16. The recycle volume ratio for vacuum bottoms stream 56 to fresh feed at 10 can be 0–1.0/1, and preferably should be 0.2–0.7/1 for achieving hydroconversion of the feedstock exceeding about 70 vol. percent. It is pointed out that by utilizing this two stage catalytic hydroconversion process, the thermal reactions and catalytic activity in each stage reactor can be effectively matched and enhanced. The remaining unconverted vacuum bottoms material not being recycled at 13 is withdrawn at 57 as a net product.

This invention will now be described further by use of the following example, which is intended to be illustrative only and should not be construed as limiting the scope of the invention.

EXAMPLE

To demonstrate the process advantages of this invention, analyses of four commercial ebullated-bed reactor cases have been developed and are presented below. The basis for these comparative cases is the catalytic two-stage ebullated bed reactor processing of a typical Arabian light/heavy vacuum resid feedstock and providing 65 and 90 vol. % hydroconversion of the 1050° F.$^+$ vacuum residua fraction and with a high percentage level of desulfurization. The vacuum residua feedstock has inspection analyses as shown in Table 3 below.

TABLE 3

FEEDSTOCK ANALYSES

| Characteristic | Value |
|---|---|
| Residue Content (1050° F.+), vol. % | 92 |
| Gravity, API | 4.7 |
| Sulfur, wt. % | 5.3 |
| Conradson Carbon Resid, wt. % | 24.6 |
| Nickel plus Vanadium, Wppm | 222 |

Two conventional process base cases No. 1 and 3 which do not incorporate features of the present invention and two improvement cases No. 2 and 4 which do incorporate features of this invention have been developed, and show clearly the process performance advantages of the invention. The cases No. 1 and 2 comparisons are both for a moderate 65 vol. % overall hydroconversion of the 1050° F.$^+$ vacuum residua fraction, and the cases No. 3 and 4 comparisons are both for a high 90 vol. % overall hydroconversion of the residua fraction to lower boiling hydrocarbon products. These examples are based on actual laboratory and commercial data at either identical or similar reaction and operating conditions, including the feedstock and catalyst characteristics. The operating conditions for the four comparison cases are provided in Table 4 below.

TABLE 4

REACTOR OPERATING CONDITIONS

| Case No. | 1 | 2 | 3 | 4 |
|---|---|---|---|---|
| Desired Overall Conversion, V % | 65 | 65 | 90 | 90 |
| First Stage Reactor | | | | |
| LHSV, V/hr/V | 0.60 | 0.60 | 0.60 | 0.60 |
| Reactor Temperature, F | 814 | 814 | 844 | 844 |
| Catalyst SV, BPD/Lb | 0.106 | 0.085 | 0.127 | 0.108 |
| Catalyst Replacement Rate, Lb/Bbl | 0.123 | 0.123 | 0.175 | 0.175 |
| Superficial Gas Velocity, Ft/Sec | 0.114 | 0.105 | 0.107 | 0.096 |
| Reactor Gas Hold-Up, V % | 20.1 | 18.5 | 18.9 | 16.9 |
| Hydrogen | | | | |
| Chemical Consumption, SCF/Bbl | 758 | 869 | 1147 | 1114 |
| Inlet Circulation Rate, X Consumption | 3.6 | 3.0 | 3.1 | 2.7 |
| Inlet Purity, vol. % | 94.9 | 92.0 | 96.1 | 92.0 |
| Partial Pressure Inlet, Psia | 2505 | 2505 | 2505 | 2505 |
| Partial Pressure Outlet, Psia | 2415 | 2046 | 2166 | 1967 |
| Second Stage Reactor | | | | |
| LHSV, V/hr/V | 0.60 | 0.60 | 0.60 | 0.60 |
| Reactor Temperature, ° F. | 814 | 814 | 844 | 844 |
| Catalyst SV, BPD/Lb | 0.106 | 0.106 | 0.127 | 0.127 |
| Catalyst Replacement Rate, Lb/Bbl | 0.123 | 0.123 | 0.175 | 0.175 |
| Superficial Gas Velocity, Ft/Sec | 0.153 | 0.069 | 0.144 | 0.079 |
| Reactor Gas Hold-Up, vol. % | 26.9 | 12.1 | 25.4 | 13.9 |
| Hydrogen | | | | |
| Chemical Consumption, SCF/Bbl | 512 | 481 | 733 | 806 |
| Inlet Circulation Rate, X Consumption | 2.1 | 3.0 | 2.0 | 2.7 |
| Inlet Purity, vol. % | 85.3 | 92.0 | 92.0 | 92.0 |
| Partial Pressure Inlet, Psia | 2206 | 2355 | 2180 | 2480 |
| Partial Pressure Outlet, Psia | 1964 | 1963 | 1949 | 1958 |

For the base cases No. 1 and 3, the catalytic ebullated-bed two-stage reactors are operated at typical pre-invention conditions including a high feed rate of hydrogen entering the first stage reactor, the upward ebullation liquid flow being provided from an internally located recycle cup or gas/liquid separator, and with all of the first stage reactor effluent material (vapor+liquid) being passed directly to the catalytic second stage reactor. The superficial gas velocities in the first and second staged reactors are about 0.11 and 0.15 ft/s respectively, and result in undesirably large gas hold-up volumes of 18–20 vol. % and 25–27 vol. % respectively in the first and second staged reactors.

For the two improvement Cases No. 2 and 4, the improved results for the present invention utilizing the same reactor total volume and liquid hourly space velocity as for the respective base Cases No. 1 and 3 are demonstrated. For the first stage reactor, the catalyst volume is increased and the catalyst space velocity is decreased by 15–20 percent due to elimination of the internal recycle cup or gas/liquid separator from the reactor upper portion. The first stage gas hold-up volume is reduced by 8–11 percent primarily because a lower hydrogen gas circulation rate and a lower hydrogen partial pressure at the reactor outlet are utilized.

More significantly, in the second stage reactor the gas hold-up volume is reduced by 45–55 percent. This reduction in second stage gas hold-up volume percentage is due to the use of interstage gas/liquid separation, and the use of a reduced minimal hydrogen gas recirculation rate. This reduction in the second stage reactor gas hold-up volume becomes available for providing increased reactor liquid volume and increases the effective liquid residence time in the second stage reactor by 20–30 percent. The comparative process performance for hydroconversion and desulfurization for the Cases No. 1 and 2, and for Cases No. 3 and 4 are shown in Table 5 below.

TABLE 5

PROCESS COMPARATIVE PERFORMANCES

| Case No. | 1 | 2 | Difference 1–2 | 3 | 4 | Difference 3–4 |
|---|---|---|---|---|---|---|
| First Stage Reactor | | | | | | |
| 1050° F.$^+$ Conversion, vol. % | 45.8 | 44.5 | −1.3 | 73.0 | 72.5 | −0.5 |
| Desulfurization, wt. % | 70.0 | 70.4 | +0.4 | 63.2 | 65.0 | +1.8 |
| Second Stage Reactor | | | | | | |
| 1050° F$^+$ Conversion, vol. % | 35.4 | 41.4 | +6.0 | 63.0 | 68.7 | +5.7 |
| Desulfurization, wt. % | 65.1 | 69.9 | +4.8 | 53.3 | 58.9 | +5.6 |
| Overall Results | | | | | | |
| 1050° F+ Conversion, vol. % | 65.0 | 67.5 | +2.5 | 90.0 | 91.4 | +1.4 |
| Desulfurization, wt. % | 89.5 | 91.1 | +1.6 | 82.8 | 85.6 | +2.8 |

It is noted that the level of first stage reactor residue conversion for the comparative cases shows a slight decrease due to higher solids hold-up. However, first stage desulfurization is increased slightly due to the higher catalyst loading and lower gas hold-up volume percentage in the reactor. Also, as a primary result of the significantly lower gas hold-up in the second stage reactor, i.e. from 26.9 to 12.1 vol. %, at moderate 65% conversion and from 25.4 to 13.9 vol. % at the higher 90% conversion, the process overall percent hydroconversion is increased from 65 to 67.5 vol. % for the moderate 65 vol. % conversion cases, and from 90.0 to 91.4 vol. % for the high 90 vol. % conversion cases. The increase in overall desulfurization from 89.5 to 91.1 wt. % in the moderate conversion cases and from 82.8 to 85.6 wt. % in the high conversion cases is a direct result of the increase in the second stage desulfurization. It should be noted that the moderate 65 vol. % conversion cases utilized a particulate catalyst having a unimodal pore size distribution, and the high conversion cases utilized a catalyst having a bi-modal pore size distribution which results in a somewhat lower desulfurization level.

Although this invention has been described broadly and also in terms of preferred embodiments, it will be understood that modifications and variations can be made to the process which are all within the basic scope of the invention as defined by the following claims.

We claim:

1. A process for catalytic multi-stage ebullated bed hydrogenation of heavy hydrocarbonaceous feedstocks for producing lower boiling hydrocarbon liquids and gases, the process comprising:

(a) feeding a heavy hydrocarbonaceous liquid vacuum residue feedstock having contaminant metal up to 1000 wppm, 10–50 wt. % Conradson Carbon Residue; and 50%–90 vol % normally boiling above 975° F. together with hydrogen gas into a first stage catalytic ebullated bed reactor, said first stage catalytic ebullated bed reactor having no internal gas/liquid separation device, at liquid space velocity of 0.2–2.0 volume of feed per hour per volume of reactor (Vf/hr/Vr), a catalyst replacement rate of 0.05–0.5 Lb/Bbl (per stage), catalyst bed expansion of 25–75%, and at catalyst space velocity of 0.03–0.33 bbl/day/lb catalyst, providing upward superficial gas velocity of 0.02–0.30 ft/sec while maintaining reaction temperatures of 700–850° F., and 800–3,000 psi hydrogen partial pressure at the reactor outlet, and producing a first stage reactor effluent material;

(b) phase separating the first stage effluent using an external gas/liquid separator, into a gas portion and a first liquid portion, and passing the first liquid portion to a second stage catalytic ebullated bed reactor maintained at near the reaction conditions of step (a), and producing a second stage effluent material;

(c) phase separating the second stage effluent material into a gas and a liquid second portion;

(d) fractionating said second liquid portion to produce a medium-boiling hydrocarbon liquid fraction product having normal boiling range of 400–650° F. and a vacuum bottoms fraction material having a normal boiling point above about 650° F.; and (e) recycling said vacuum bottoms fraction material directly to said first stage catalytic ebullated bed reactor to provide a recycle volume ratio of the vacuum bottoms material to fresh feedstock of 0–1.0/1;

whereby steps a–e result in greater than 50% vol. % conversion of the 975° F.$^-$ fraction in the feedstock to lower-boiling hydrocarbon liquid and a desulfurization of greater than 65 wt. %.

2. A hydrogenation process according to claim 1, wherein said first stage reaction conditions are 750–840° F. temperature, 1,000–2,500 psig hydrogen partial pressure at the reactor outlet, 0.40–1.2 $V_f/Hr/V_r$ liquid space velocity and 0.04–0.20 Bbl/day/lb. catalyst space velocity.

3. A hydrogenation process according to claim 1, wherein said second stage reaction conditions are 750–840° F. temperature, 1,000–2,500 psig hydrogen partial pressure at the reactor outlet 0.40–1.2 $V_f/Hr/V_r$ liquid space velocity, and 0.04–0.20 Bbl/day/lb. catalyst space velocity.

4. A hydrogenation process according to claim 2, wherein the reactor superficial gas velocity is 0.025–0.20 ft./sec.

5. A hydrogenation process according to claim 3, wherein the reactor superficial gas velocity is 0.025–0.20 ft./sec.

6. A hydrogenation process, according to claim 1, wherein a height distance of 5–10 ft. is maintained in the first stage catalytic reactor between the ebullated bed upper level and the reactor outlet connection.

7. A hydrogenation process according to claim 1, wherein said recycled vacuum bottoms material has a normal boiling point above about 900° F. and is recycled to the first stage reactor at a volume ratio of vacuum bottoms material to fresh feed of 0–1.0/1 to achieve 65–90 vol. % conversion of the feedstock to lower-boiling hydrocarbon liquid products.

8. A hydrogenation process according to claim 1, wherein the volume ratio of vacuum bottoms material recycled to said first stage reactor to the fresh feedstock being fed to said first stage reactor is about 0.2/1–0.7/1.

9. A hydrogenation process according to claim 1, wherein the catalyst used in said first stage and second stage reactors contains 2–25 wt. % total active metals and has total pore volume of 0.30–1.50 cc/gm, total surface area of 100–400 $m^2$/gm and average pore diameter of at least 50 angstrom units.

10. A hydrogenation process according to claim 1, wherein the catalyst used in the first stage and second stage reactors has total pore volume of 0.40–1.20 cc/gm, total surface area of 150–350 $m^2$/gm and average pore diameter of 80–250 angstrom units.

11. A hydrogenation process according to claim 1, wherein the catalyst used in said second stage catalytic reactor contains 5–20 wt. % cobalt-molybdenum on alumina support material.

12. A hydrogenation process according to claim 1, wherein the catalyst used in said second stage catalytic reactor contains 5–20 wt. % nickel-molybdenum on alumina support material.

13. A hydrogenation process according to claim 1, wherein used catalyst is withdrawn from said second stage catalytic reactor and passed to said first stage catalytic reactor as the catalyst addition therein, and fresh catalyst replacement rate of 0.05–0.50 pound catalyst per barrel of the fresh feedstock is provided to said second stage reactor.

14. A hydrogenation process according to claim 1, wherein the second stage reactor temperature is 0–50° F. below the first stage reactor temperature so as to prehydrogenate the feedstock in the first stage reactor so that 50–100 vol. % hydroconversion of 975° F.$^+$ residua is achieved in the second stage reactor, and the recycle rate is 0.2–0.7/1.

15. A hydrogenation process according to claim 1, wherein the feedstock is petroleum residua material having 50–90 vol. % normally boiling above 975° F. and containing 10–50 wt. % Conradson Carbon Residue (CCR) and greater than 100 wppm total metals.

16. A hydrogenation process according to claim 1 wherein the feedstock is bitumen.

* * * * *